United States Patent [19]

Olsen

[11] Patent Number: 5,048,253

[45] Date of Patent: Sep. 17, 1991

[54] LOUVER WITH MAXIMUM FREE AREA

[75] Inventor: Robert W. Olsen, Washington, N.J.

[73] Assignee: Construction Specialties, Inc., Cranford, N.J.

[21] Appl. No.: 636,753

[22] Filed: Jan. 2, 1991

[51] Int. Cl.[5] ..... E06B 7/08

[52] U.S. Cl. ..... 52/473; 49/91; 98/121.1; 98/121.2

[58] Field of Search ..... 52/473; 49/91, 92, 371, 49/74; 98/121.1, 121.2

[56] References Cited

U.S. PATENT DOCUMENTS

| | | | |
|---|---|---|---|
| 3,358,580 | 12/1967 | Freese et al. | 98/121.1 |
| 3,484,990 | 12/1969 | Kahn et al. | 49/91 |
| 4,103,468 | 8/1978 | Olsen | 52/473 |
| 4,310,993 | 1/1982 | White | 52/473 |
| 4,452,024 | 6/1984 | Sterriker et al. | 52/473 |

*Primary Examiner*—Philip C. Kannan

*Attorney, Agent, or Firm*—Brumbaugh, Graves, Donohue & Raymond

[57] ABSTRACT

The cross sections of louver blades are located exclusively within zones defined primarily by concentric arcs configured to maintain a substantially equal spacing between the boundaries of the zones of adjacent blades throughout the width of the louver.

1 Claim, 7 Drawing Sheets

LOUVER WITH MAXIMUM FREE AREA

BACKGROUND OF THE INVENTION

The "free area" of a louver is defined by the Air Movement and Control Association (AMCA) in AMCA Standard 500, "Test Methods for Louvers, Dampers and Shutters," as "the minimum area through which air can pass" and is determined by multiplying the sum of the minimum distances between intermediate blades, top blade and head, and bottom blade and sill by the minimum distance between jambs. The percent free area is the free area divided by the gross area $\times 100$. The distances, in turn, are between points on the adjacent members (blades, sill and head, as the case may be) that are closest to each other in any direction. To minimize the size of the opening at the building face and the size and cost of the louver for a given air-flow capacity, it is desirable to design the louver to have a maximum free area. Because of irregularities, such as drainage troughs, offsets, flanges, screw bosses and the like, in the blade cross sections, few, if any, louvers currently on the market have a maximum free area.

SUMMARY OF THE INVENTION

One object of the present invention is to provide a louver having a maximum free area. Achieving that object requires that all elements of the blade cross section be located within a carefully designed zone. Another object is to bias the zone such that a larger portion of the zone is at the lower front part of the blade and a smaller portion is at the upper rear part or vice versa. Still a further object is to create a "design zone" for the blade cross sections of louvers in order to provide greater freedom in the design of a louver system composed of a family of different louvers, all with the same free area, which may not be the maximum possible free area, but with variations in the blade cross sections. The foregoing objects are attained, according to the present invention, by a louver having a multiplicity of blades of identical cross section mounted in uniformly spaced relation and in uniform orientations relative to a front plane and a rear plane defined by their front and rear extremities. The invention is characterized in that each cross section along the length of each blade occupies a zone defined by:

(a) front and rear lines in the front and rear planes, respectively;

(b) first and second points located respectively in parallel upper and lower lines spaced-apart by a selected distance T not less than the blade thickness, oriented obliquely to the front and rear planes at a selected blade slope angle and intersecting the front plane at respective upper and lower front points and the rear plane at respective upper and lower rear points;

(c) a first upper arc tangent to the upper line at the first point, having a radius C equal to the perpendicular distance between the upper line of the zone and the lower line of the zone next above, having its center at the lower front point of the zone next above and intersecting the front line;

(d) a first lower arc tangent to the lower line at the second point, having the same radius C as the upper front arc, having its center at the upper rear point of the zone next below and intersecting the rear line;

(e) a second lower arc tangent to the lower line at the lower front point, having a radius equal to the sum of two times C and T and having its center at the upper rear point of the second zone below;

(f) a second upper arc having a radius equal to the sum of C and T, having its center at the upper rear point of the zone next below and tangent to the upper line at the first point;

(g) a third upper arc having a radius equal the to the sum of two times C and T, intersecting the rear line at the upper rear point and tangent to the second upper arc; and (h) a third lower arc having a radius equal to the sum of C and T, intersecting the first and second lower arcs tangentially and having its center coincident with the center of the third upper arc of the zone next below.

For a better understanding of the invention reference may be made to the following description of an exemplary embodiment, taken in conjunction with the accompanying drawings.

DESCRIPTION OF THE EMBODIMENTS

Ordinarily, a louver consists of a peripheral frame defining a rectangular opening and a number of identical blades mounted horizontally in the frame at uniform vertical spacings. In fixed blade louvers the blades are permanently affixed to the side members of the frame, usually at the same slopes. In operating louvers the blades are mounted to pivot under the control of a mechanism that enables their slopes to be adjusted; usually, operating louvers are set to either a fully opened or a fully closed position. The blades of most louvers have front and rear flanges that provide structural strength and stiffness. The blades may also have offsets, screw bosses, drainage troughs and other perturbations in their cross sections. In most, if not all, louvers the perturbations in the blade cross section reduce the free area by reducing the distance between the blades below what it would otherwise be if they were not present.

Figure 1:
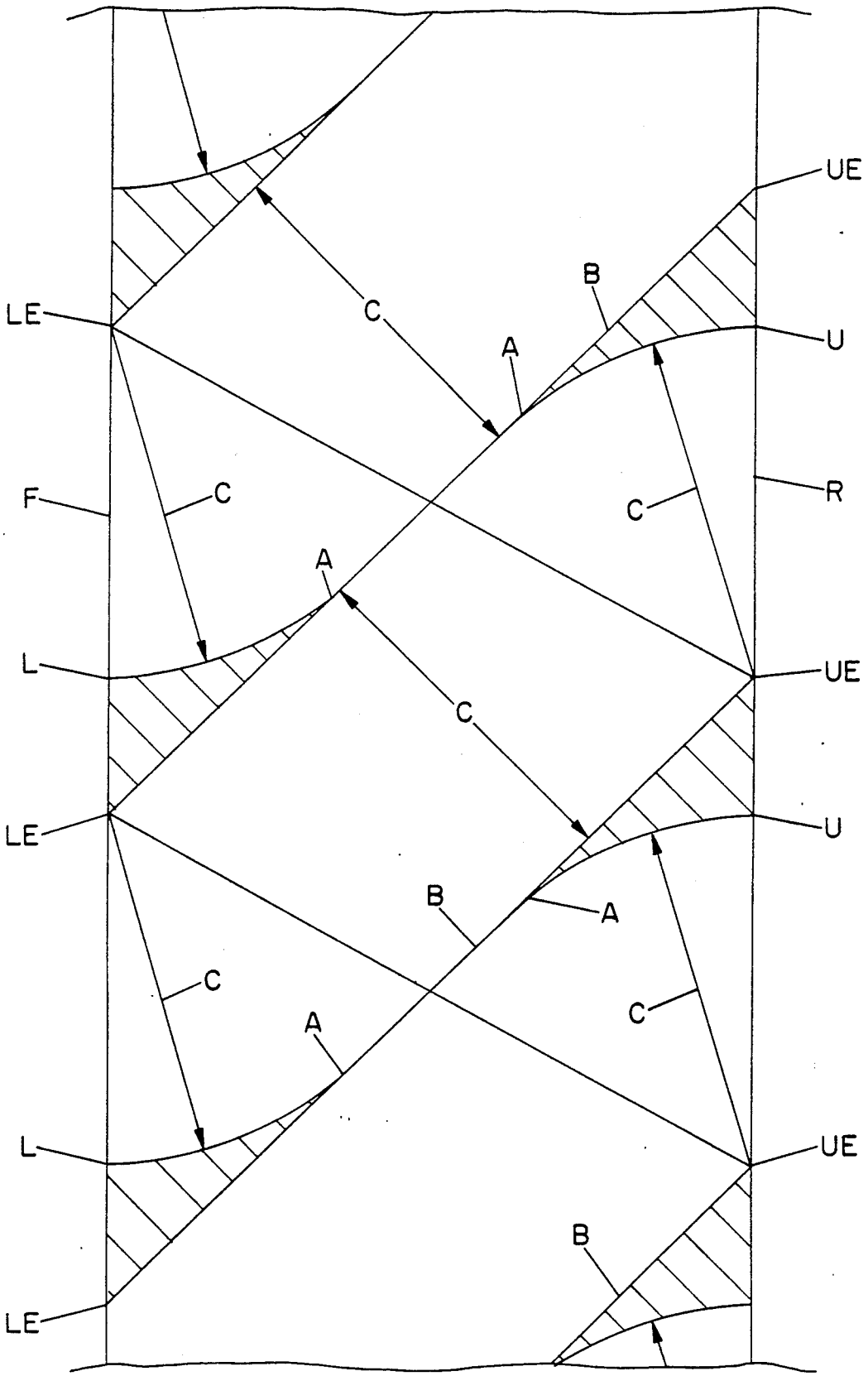
FIG. 1 is a diagram showing one aspect of providing zones for the blade cross sections that produce a maximum free area in a louver.

FIG. 1 depicts diagrammatically a vertical cross section of a portion of a louver. The vertical lines F and R represent the front and rear planes defined by the front and rear extremities of the blades. The diagonal lines B represent blades of planar configuration spaced apart by a clearance spacing C. Inasmuch as the definition of "free area" is based on the minimum spacing between the blades in a plane perpendicular to the axes of the blades, the free area will be based on the clearance spacing C. However, in the lower front portion of each space between blades is a region in which the lower edge LE of the upper blade is spaced at a distance greater than C from the lower blade; similarly, a region of greater spacing occurs in each space between the upper edge UE of each blade and the blade below it. These regions of greater spacing between adjacent blades present opportunities for adding appendages to the blade cross sections without reducing the clearance below the dimension C. In particular the dimension C may be maintained in these regions by striking arcs AL and AU having radii equal to C from the points LE and UE. Portions of the blade cross sections may occupy the shaded areas defined by the arc LE and UE and the blade planes without reducing the free area of the louver.

Figure 2:
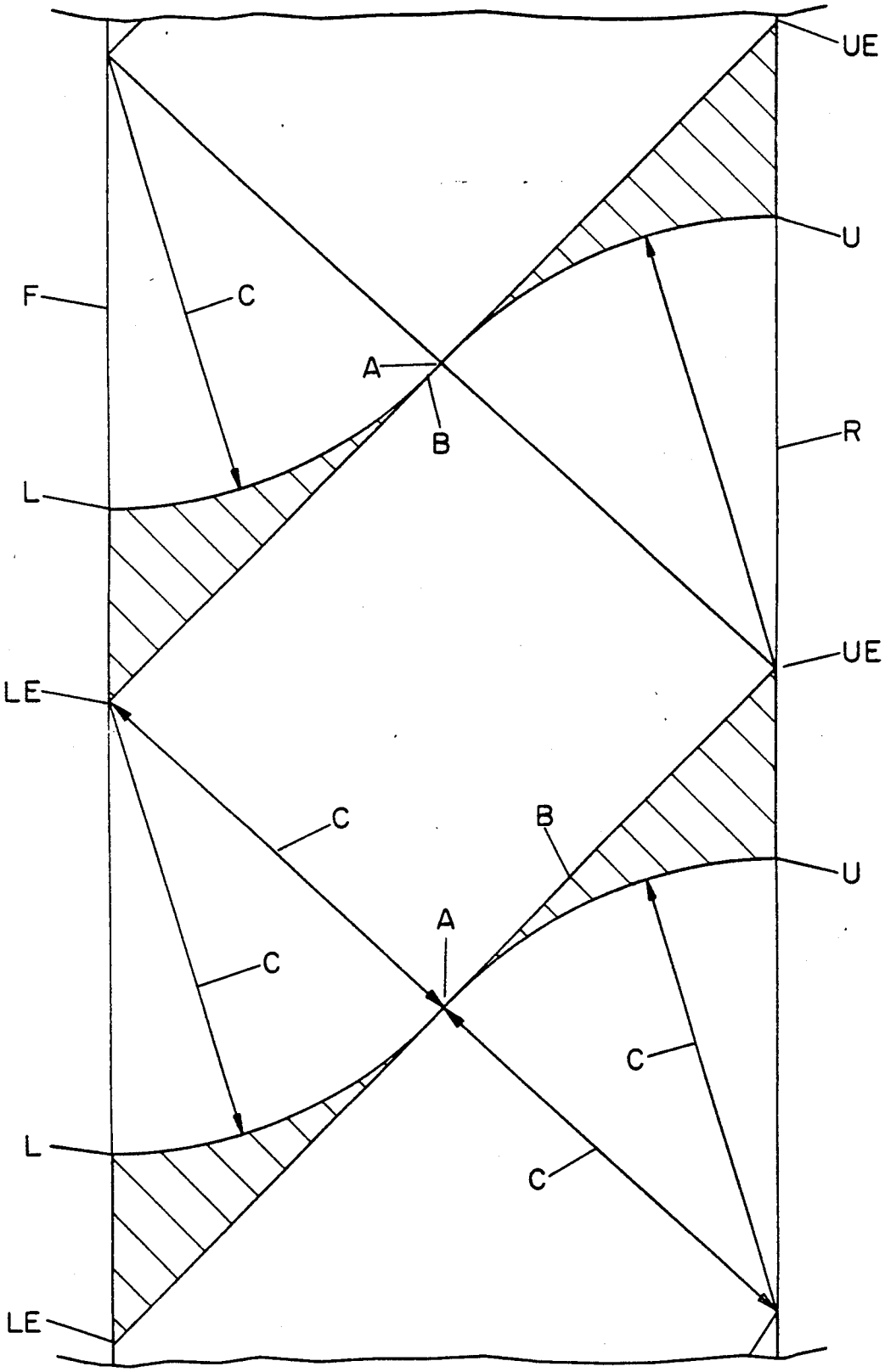
FIG. 2 is a diagram showing how the depth of the louver and the spacing and slope of the blades affects the size of the zone of each blade cross section.

In the louver shown schematically in FIG. 1, the blades are oriented at a relatively low slope to the front plane and have an overlap of the rear edge of each blade above the front edge of the blade above. The low slope and the overlap combine to make the shaded zones that can be occupied by portions of the blade cross sections without reducing the free area relatively small. FIG. 2 shows schematically a louver having blades oriented at greater slopes, but also having positive overlaps. It will be seen that the areas into which the blade cross sections may extend are greater that those of FIG. 1. In both FIGS. 1 and 2 if any portion of the blade cross section falls outside of the shaded areas and the line between them, the minimum dimension between the blades is reduced and the free area is reduced commensurately.

Figure 3:
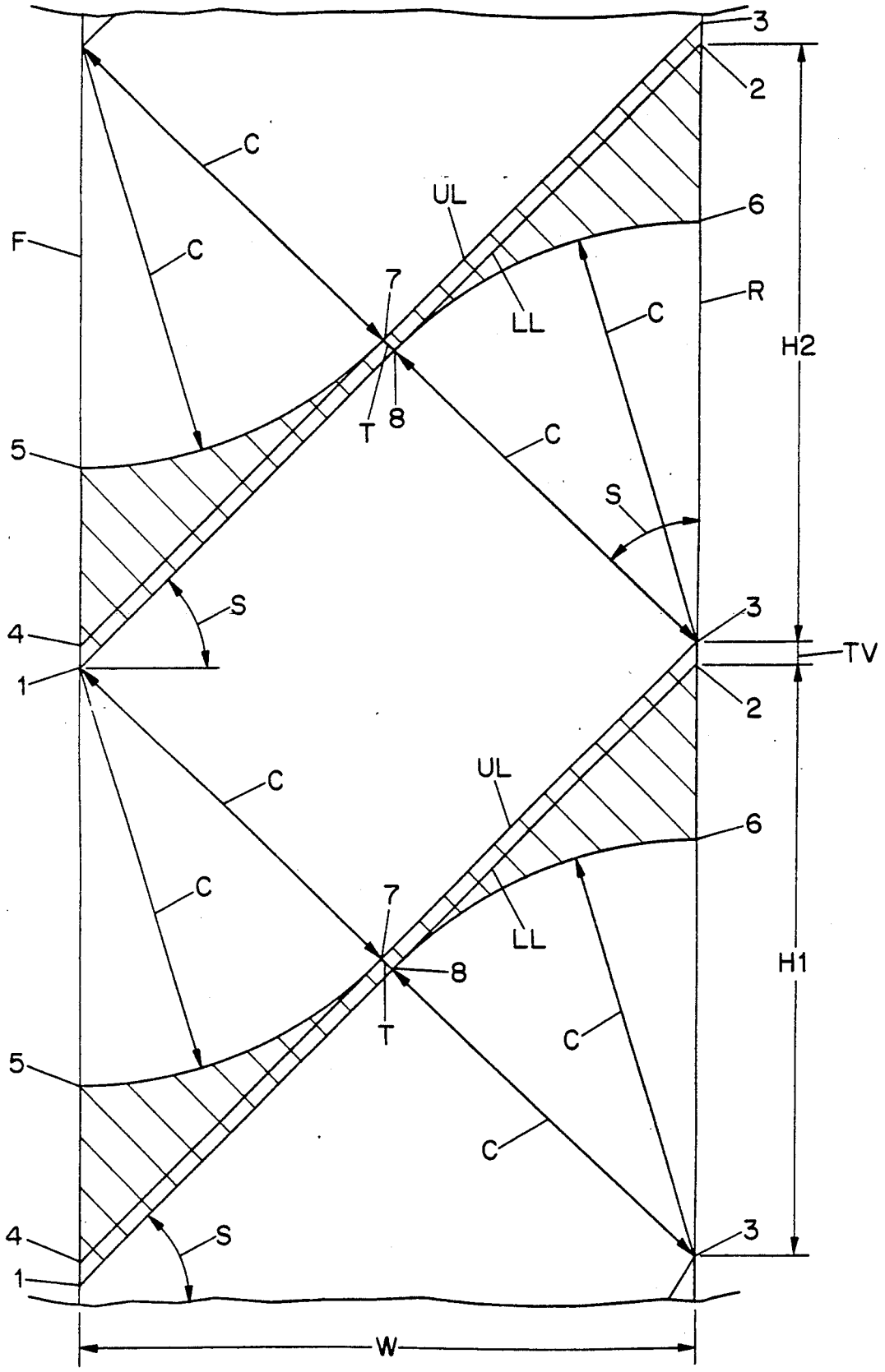
FIG. 3 is a diagram showing how the zone for each blade cross section is maximized as a function of the depth of the louver, the blade spacing and the blade slope.

In FIG. 3 a louver is depicted in which the areas into which portions of the blade cross section can extend without reducing the minimum blade clearance below C are proportionately greater than those of either FIGS. 1 or 2. In FIG. 3 a blade thickness T, shown greatly exaggerated for clarity, is taken into account. Generally, the design of a louver begins with the selection of a depth W and either a blade slope or overlap. In the illustrated case it has been decided to have a slope angle S. A blade thickness T has also been selected. With the objective of defining arcs like those of FIGS. 1 and 2 but tangent to the blade surfaces at the center, the blade locations and spacings can be calculated from relatively simple trigonometric functions, to wit:

Starting with point 1, the intersection of a lower line LL of a blade zone with the front plane F, the vertical dimension H1 from point 1 to point 2 (intersection of line LL with the rear plane) is calculated from $H1=W(\tan S)$. The vertical dimension TV of the thickness T between the thickness lines LL and UL is $T/\cos S$. If the arcs defining blade zones of maximum size are to bisect the nominal blade width BW, a line connecting point 3 of the zone of one blade with point 1 of the second blade above it must be perpendicular to the upper blade line 3-4 and must have a length equal to 2C plus T, where C is again the blade clearance spacing. Accordingly, C can be determined from the equation, $\sin S=W/(2C+T)$ or $C=(W/\sin S-T)/2$. Then the vertical distance H2 between the upper line of one blade zone and the lower line of the blade zone next above it can be calculated from the equation, $H2=C/\cos S$. At this point the dimensions of the louver and of part of the zone of each blade are partially established. Now the arcs of radius C may be formed about the points 1 and 3 as shown in FIG. 3. The zone that may be occupied by each blade without reducing the free area of the louver below a maximum based on the clearance spacing C between the blades consists of lines 1-5 and 3-6 in the front and rear planes, segments 3-7 and 1-8 of the upper and lower thickness lines UL and LL and arcs 5-7 and 6-8 that are tangent to the thickness lines and intersect the respective front and rear planes. The dimensions and geometry of the louver shown in FIG. 3 provide both a maximum free area for a louver with blades of a given thickness and a maximum area for excursion of elements of the blade cross sections (compare FIGS. 1, 2 and 3).

Figure 4:
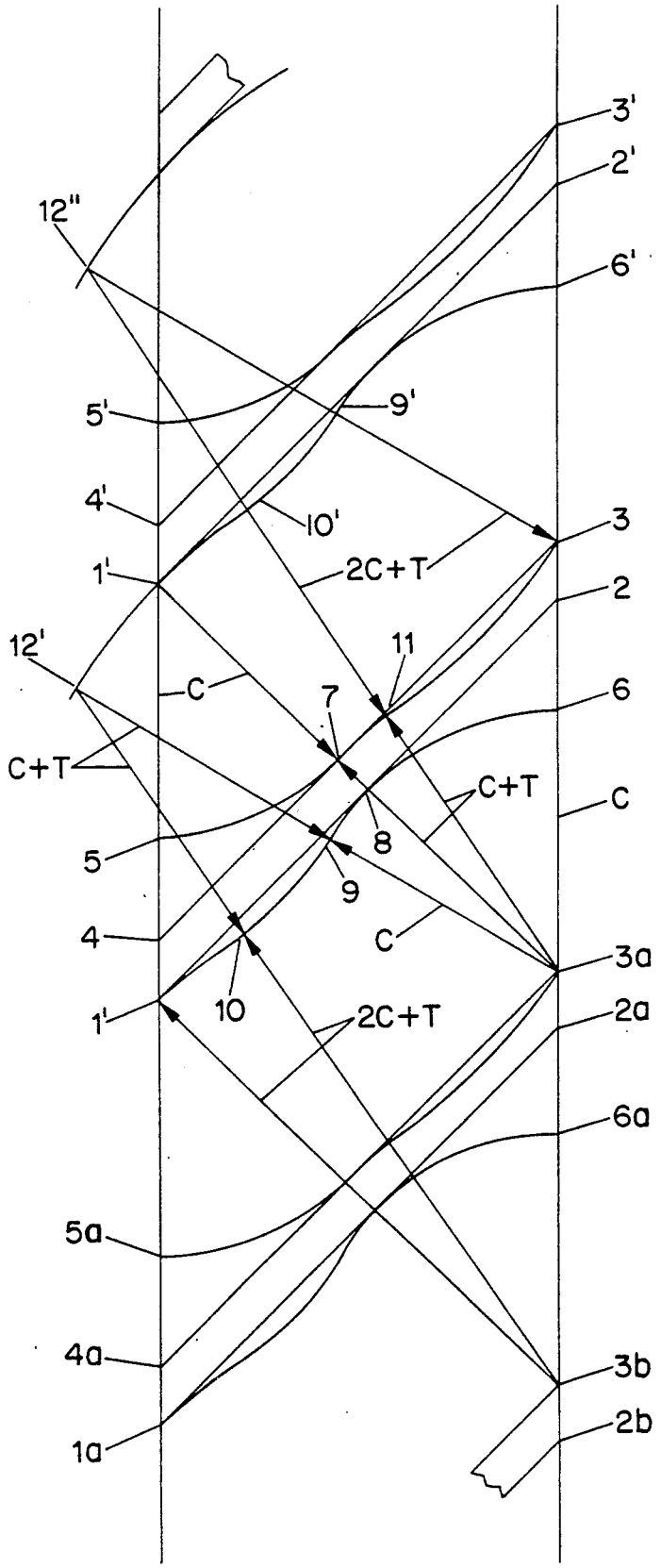
FIG. 4 is a diagram showing how the zone of each blade cross section is both maximized in size and biased to the lower front portion of the cross section.

FIG. 4 shows the zones of FIG. 3 and adds the next concept of the invention, which is that the spaces between adjacent blades may be further defined by concentric arcs spaced apart by the dimension C of the clearance space. Following this concept permits the biasing of the zone that can be occupied by the cross section of each blade to the lower front or upper rear of the space, as may be desired to meet other design criteria, such as the provision of larger drainage troughs than may otherwise be possible at the fronts of the blades of a drainable louver or to provide more room at the backs of the blades for blade edge gaskets.

In FIG. 4 the zone of the cross section of each blade is defined by (a) front and rear lines 1-5 and 3-6 in the front and rear planes, respectively; (b) first and second points 7 and 8 located respectively in parallel upper and lower lines 4-3 and 1-2 spaced-apart by a distance T equal to the blade thickness, oriented obliquely to the front and rear planes at a selected nominal blade slope angle and intersecting the front plane at respective upper and lower front points 4 and 1 and the rear plane at respective upper and lower rear points 2 and 3; (c) a first upper arc 5-7 intersecting the upper line 4-3 tangentially at the first point 7, having a radius C equal to the perpendicular distance between the upper line of the zone and the lower line of the zone next above, having its center at the lower front point 1' of the zone next above and intersecting the front line; (d) a first lower arc 9-6 intersecting the lower line 1-2 tangentially at the second point 8, having the same radius C as the upper front arc, having its center at the upper rear point **3*a* of the zone next below, and intersecting the rear line 3-6; (e) a second lower arc 1-10 tangent to the lower line 1-2 at the lower front point 1, having a radius equal to the sum of two times C and T (2C+T) and having its center at the upper rear point 3*b* of the second zone below; (f) a second upper arc 7-11 having a radius equal to the sum of C and T (C+T), having its center at the upper rear point 3*a* of the zone next below and tangent to the upper line 4-3 at the first point 7; (g) a third upper arc 3-11 having a radius equal to the sum of two times C and T (2C+T), intersecting the rear line 6-3 at the upper rear point 3 and intersecting the second upper arc 7-11 tangentially; and (h) a third lower arc 10-9 having a radius equal to the sum of C and T (C+T), intersecting the first and second lower arcs tangentially and having its center coincident with the center of the third upper arc of the zone next above. Because the second upper rear arc 11-3 intersects the upper rear point 3, its center 12''** lies on the extension of the second lower arc of the second zone above.

The clearance space between the zones of the cross sections of adjacent blades is held equal to C throughout its extent as follows: In the lower front and upper rear regions the clearance space is defined by the pie-shaped portions 1'-5-7-1' and 3-6'-9'-3, each of which is bounded by an arc having a radius equal to the clearance distance C. The region immediately to the rear of the front pie-shaped portion is a region 1'-7-11-10'-1' defined at its upper and lower boundaries by concentric arcs spaced apart from each other by the clearance distance C. A region 10'-11-3-9'-10' is also bounded by concentric arcs, the radii of which differ by the clearance distance C.

The louver blades need not and almost certainly will not occupy the entireties of their respective zones, as will be apparent from the embodiments described below and shown in FIGS. 5 to 7 of the drawings. On the other hand no part of any blade can project outside of its zone, lest the free area be diminished. In the case of operating louvers the zones are defined with respect to the fully open positions of the blades. In an louver embodying the present invention the concept of defining a portion of the clearance space between adjacent blades by concentric arcs can be applied to increase the area of the zone at the upper rear of the space rather than the lower front; accordingly, the terms "front," "rear," "lower," and "upper" are used herein for convenience and are intended to be construed to apply to inversions of the zones described, shown and claimed.

Figure 5:
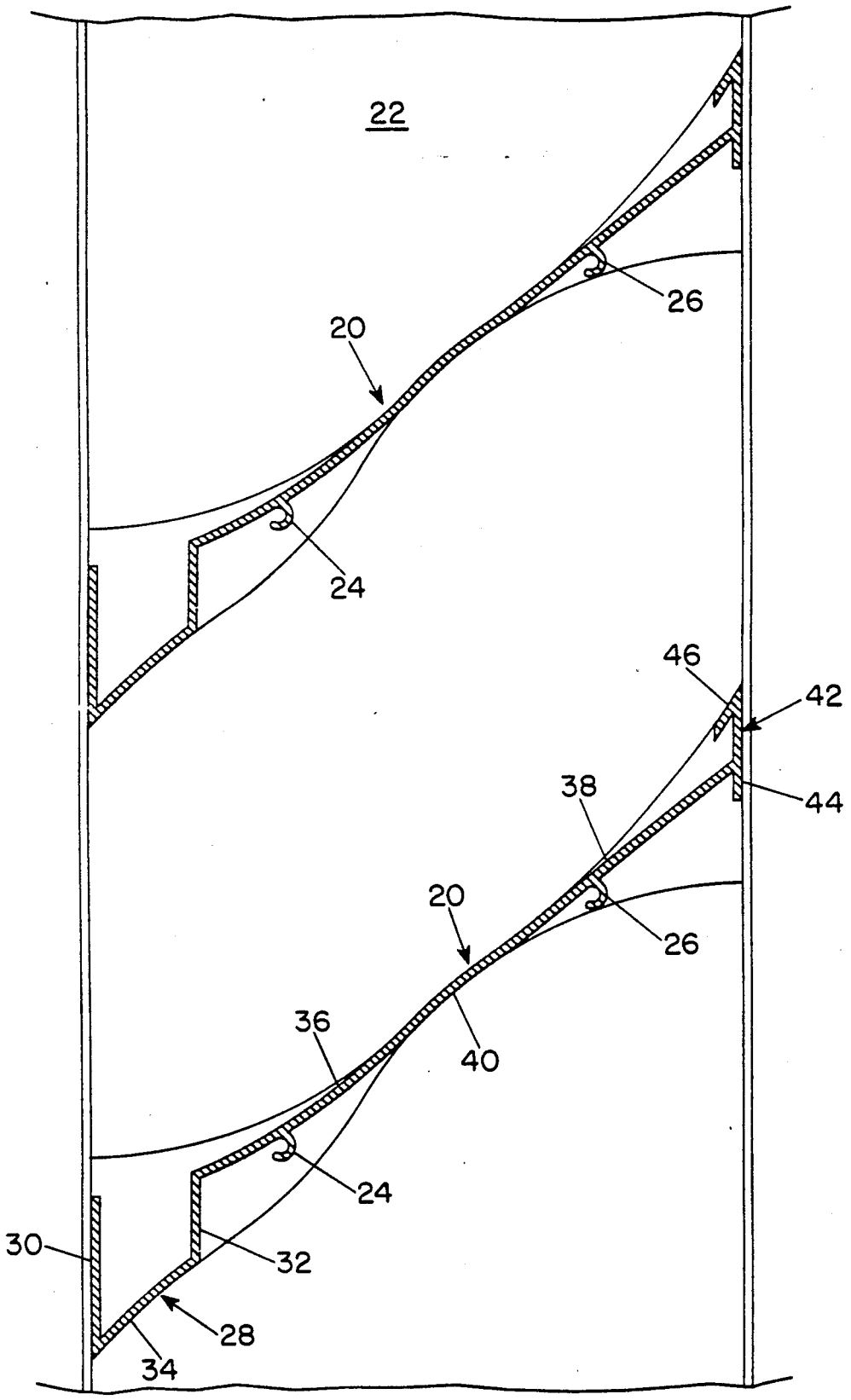
FIG. 5 is a partial transverse cross sectional view of a louver embodying the present invention.

The louver shown (partly) in FIG. 5 comprises a number of identical blades 20 mounted horizontally in equally spaced-apart, parallel relation between the vertical members 22 (jambs or mullions) of a frame by means of screws (not shown) received through holes in the frame and threaded into screw bosses 24 and 26 formed on the blades. The blades are made of aluminum and are formed by extrusion and, therefore, are of uniform cross section along their lengths. The blades are of the drainable type and thus include a drainage trough portion 28 at the lower front edge defined by a front flange 30 that lies in the front plane of the blade array, a rear flange 32 oriented vertically, and a sloping bottom 34. The major portion of each blade in cross section is constituted by a lower, slightly upwardly concave section 36, an upper, slightly upwardly concave section 38 and an intermediate slightly upwardly convex section 40. An inverted generally L-shaped flange 42 at the upper rear edge of the blade serves as a water dam that prevents wind-blown water from being swept over the top edge of the blade. The longer leg 44 of the flange 42 lies in the rear plane of the blades array; the shorter leg 46 lies oblique to the rear plane.

As is apparent from the overlaying of the zone of each blade, which is established in accordance with the principles described above and shown in FIG. 4, all elements of the blade fall within the zone that provides for maintaining a maximum free area for the louver. In this respect the embodiment benefits from a biasing of the area of the zone toward the lower front of the blade in that the size of the drainage trough is greater than it otherwise could be without the biasing. The bottom wall 28 of the drainage trough matches the zone of the blade, as do the sections 36, 38, and 40 and the shorter leg 46 of the flange 42. Also, the screw bosses 24 and 26 are located within the prescribed zone.

Figure 6:
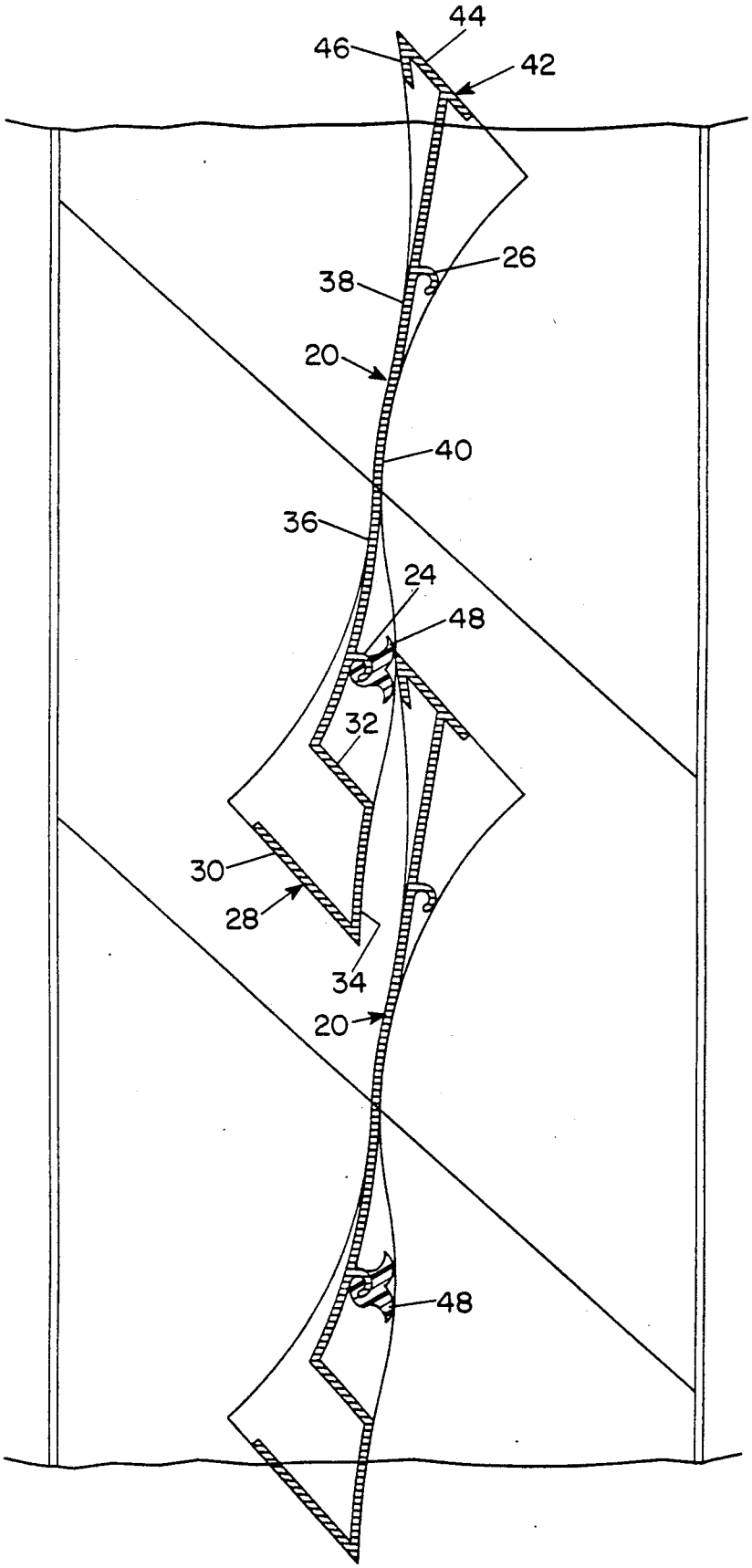
FIG. 6 is a partial transverse cross sectional view of another embodiment of the invention.

The blades of FIG. 5 can be used in a fixed louver or, as shown in FIG. 6, in an operating louver. In the latter case the blades are attached by a mounting bracket (not shown) to an operating linkage (not shown) in each vertical frame member. When the louver is fully open, its configuration conforms to that shown in FIG. 5. In the closed position (FIG. 6) the upper edge of each blade engages a seal element 48 received in the front screw boss 24. The design of the zone of the blade cross section permits the seal to be used in this location without reducing the free area.

Figure 7:
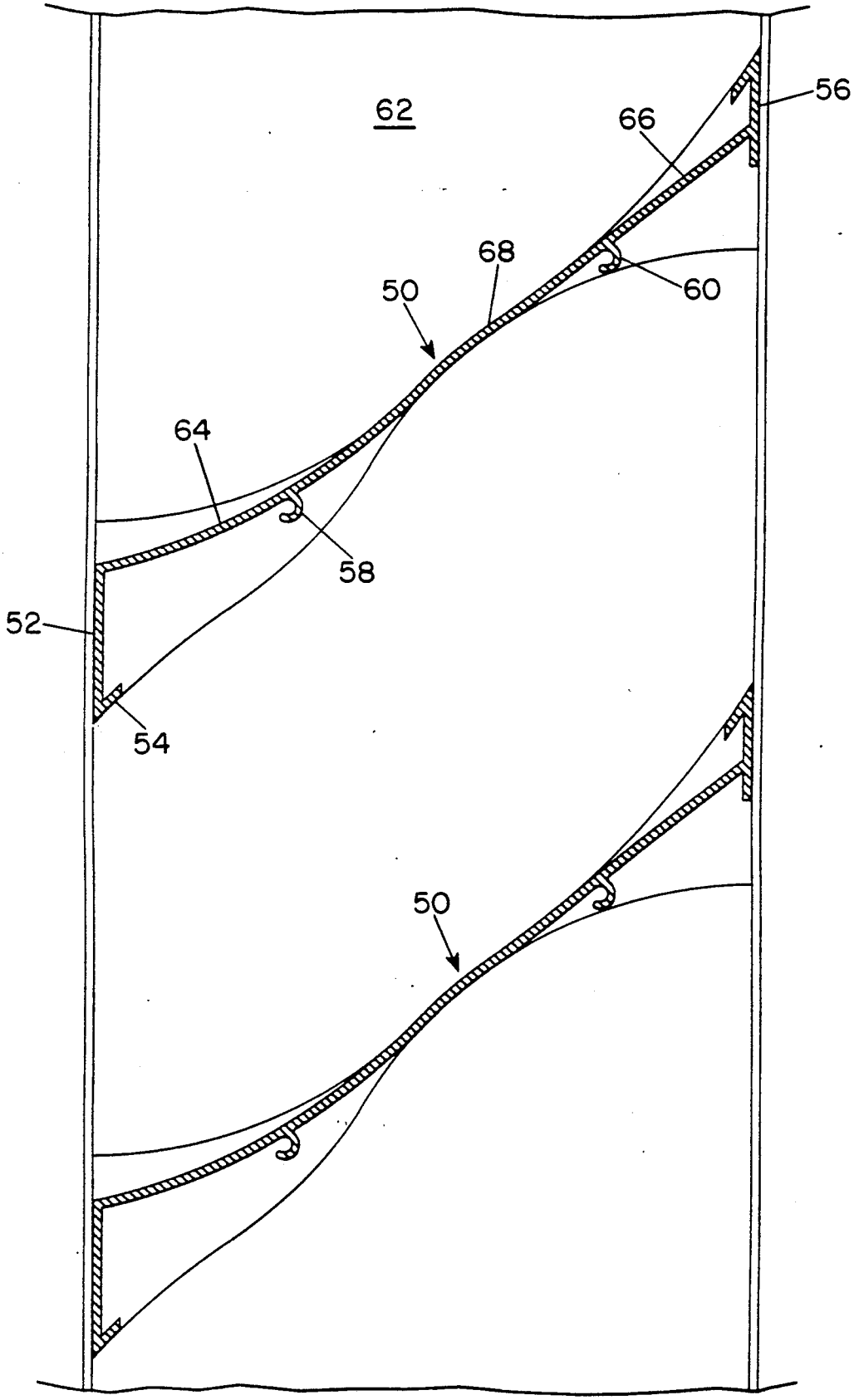
FIG. 7 is a partial transverse cross sectional view of a third embodiment of the invention.

The louver of FIG. 7 comprises an array of plain blades 50, each of which includes a vertically oriented front flange 52 located in the front plane of the blade array, a stiffener rib 54 extending obliquely upwardly and rearwardly from the lower edge of the flange 52, an upper flange 56 serving as a water dam, and screw bosses 58 and 60 for attaching the blade to a vertical frame member 62 or to a bracket in the case of an operating louver. The lower section 64 and upper section 66 of the blade are upwardly concavely curved and the intermediate section 68 upwardly convexly curved to match the zone that provides a maximum free area, as described above. The widths and slopes of the blades and the locations of the screw bosses are the same as those of the drainable blades of FIG. 5, so both the drainable and the plain blades of the present invention can be used interchangeably in the same side frame members.

In the foregoing description, the creation of louvers with maximum free areas has been emphasized. The present invention is not limited to louver designs with maximum free areas but can also be applied to louver systems composed of several different louvers (louvers with different blade cross sections), all of which have the same free area. For example, greater freedom of design for variations in the blade cross sections may be achieved by selecting a value for T that is greater than the blade thickness, which will permit greater excursions of the blade cross sections in regions near the transverse centers.

I claim:

1. A louver having a multiplicity of blades of identical cross section mounted in uniformly spaced relation and in uniform orientations relative to a front plane and a rear plane defined by their front and rear extremities characterized in that each cross section along the length of each blade is located exclusively within a zone defined by:

(a) front and rear lines in the front and rear planes, respectively;

(b) first and second points located respectively in parallel upper and lower lines spaced-apart by a selected distance T not less than the blade thickness, oriented obliquely to the front and rear planes at a selected blade slope angle and intersecting the front plane at respective upper and lower front points and the rear plane at respective upper and lower rear points;

(c) a first upper arc tangent to the upper line at the first point, having a radius C equal to the perpendicular distance between the upper line of the zone and the lower line of the zone next above, having its center at the lower front point of the zone next above and intersecting the front line;

(d) a first lower arc tangent to the lower line at the second point, having the same radius C as the upper front arc, having its center at the upper rear point of the zone next below and intersecting the rear line;

(e) a second lower arc tangent to the lower line at the lower front point, having a radius equal to the sum of two times C and T and having its center at the upper rear point of the second zone below;

(f) a second upper arc having a radius equal to the sum of C and T, having its center at the upper rear point of the zone next below and tangent to the upper line at the first point;

(g) a third upper arc having a radius equal the sum of two times C and T, intersecting the rear line at the upper rear point and tangent to the second upper arc; and (h) a third lower arc having a radius equal to the sum of C and T, intersecting the first and second lower arcs tangentially and having its center coincident with the center of the third upper arc of the zone next below.

* * * * *